United States Patent [19]

Back

[11] Patent Number: 5,000,730

[45] Date of Patent: Mar. 19, 1991

[54] SCREW JOINT

[75] Inventor: Arne Back, Vikmanshyttan, Sweden

[73] Assignee: AB Kompositprodukter S.K.-F.M., Vikmanshyttan, Sweden

[21] Appl. No.: 278,507

[22] PCT Filed: Jun. 11, 1987

[86] PCT No.: PCT/SE87/00276

§ 371 Date: Nov. 28, 1988

§ 102(e) Date: Nov. 28, 1988

[87] PCT Pub. No.: WO87/07533

PCT Pub. Date: Dec. 17, 1987

[30] Foreign Application Priority Data

Jun. 16, 1986 [SE] Sweden ..... 8602676

[51] Int. Cl.[5] ..... B04B 7/00

[52] U.S. Cl. ..... 494/38; 494/42; 494/60

[58] Field of Search ..... 494/38, 39,.42, 60, 494/64, 81, 68; 220/288

[56] References Cited

U.S. PATENT DOCUMENTS

| | | | |
|---|---|---|---|
| 607,109 | 7/1898 | Bergh | 494/64 |
| 1,032,641 | 7/1912 | Wright | 494/64 |
| 2,087,630 | 7/1937 | Schelbeck | 494/64 |
| 3,012,710 | 12/1961 | Steinacker | 494/38 |
| 3,125,516 | 3/1964 | Kaldewey | 494/38 |
| 3,239,136 | 3/1966 | Hein | 494/38 |
| 3,250,463 | 5/1966 | Thylefors | 494/40 |
| 3,319,880 | 5/1967 | Pause | 494/43 |
| 3,539,096 | 11/1970 | Lewis | 494/39 |
| 3,640,452 | 2/1972 | Thylefors | 494/60 |
| 3,656,685 | 4/1972 | Kjellgren | 494/42 |
| 3,899,128 | 8/1975 | Joyce | 494/38 |
| 4,059,223 | 11/1977 | Lewis | 494/64 |
| 4,177,921 | 12/1979 | Nielson | 494/38 |
| 4,342,419 | 8/1982 | Conway | 494/38 |

*Primary Examiner*—Frankie L. Stinson

*Attorney, Agent, or Firm*—Sughrue, Mion, Zinn, Macpeak & Seas

[57] ABSTRACT

A screw joint between two components, such as the rotor (3) and a lid locking ring (5) of an ultracentrifuge. During rotation the forces transferred by the screw joint and/or the centrifugal forces acting on the components tend to give rise to uneven distribution of the load between the threads of the screw joint. For distributing the forces transferred by the screw joint more uniformly, one of the components (3, 5) includes, a part (7) intended to be deformed due to the rapid rotation of the component to strive to rotate the component about axes perpendicular to axial sections through the center axis of the screw joint. In this way, variable contributions to the radial deformation of this component are produced along the axial extension of the screw joint, so that the load distribution is equalized between the screw threads.

14 Claims, 5 Drawing Sheets

FIG. 2
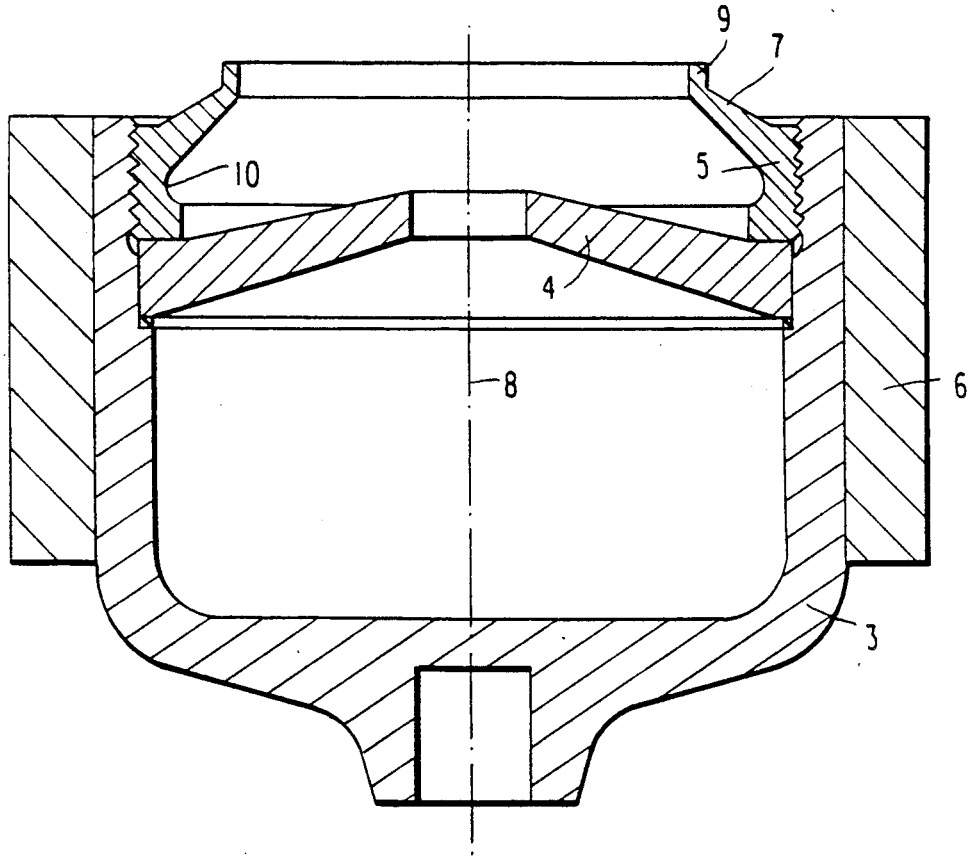
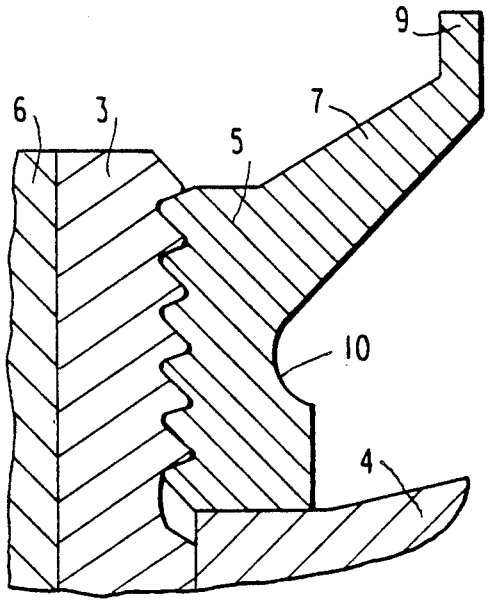
FIG. 3
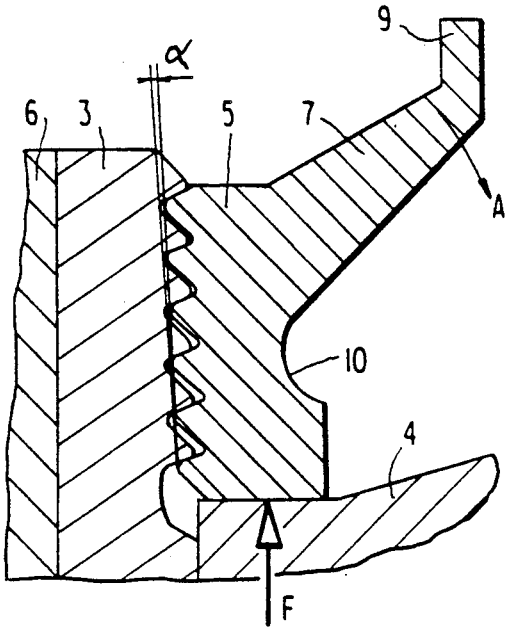
FIG. 4

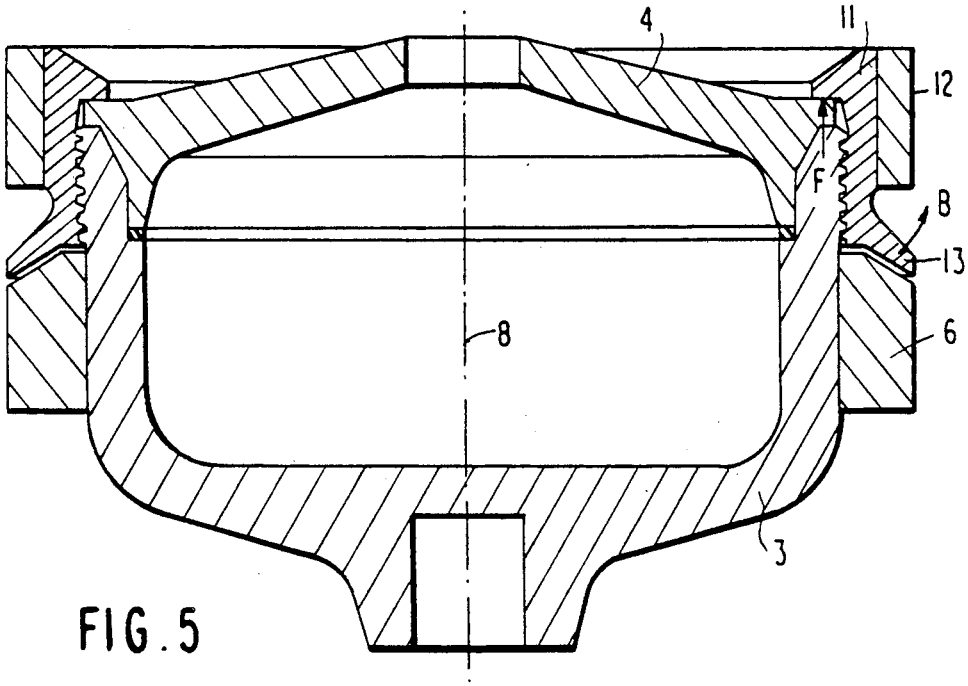
FIG. 5
FIG. 6
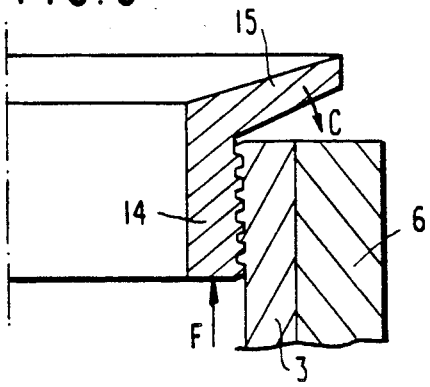
FIG. 7
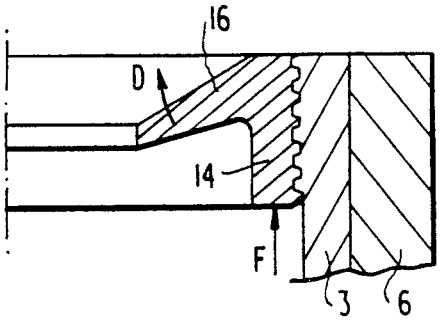
FIG. 8
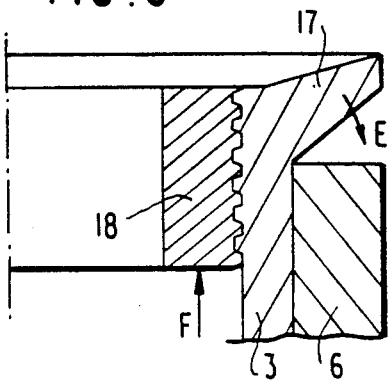
FIG. 9
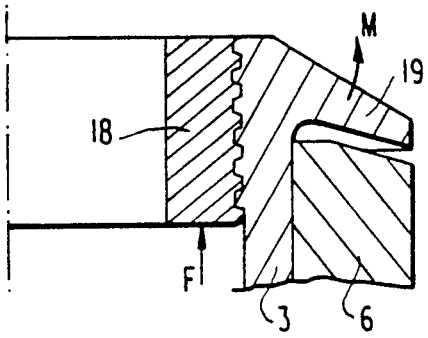

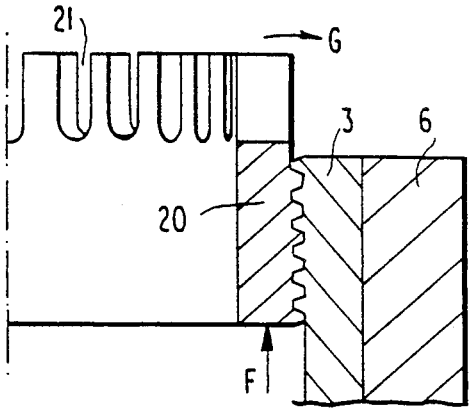
FIG. 10
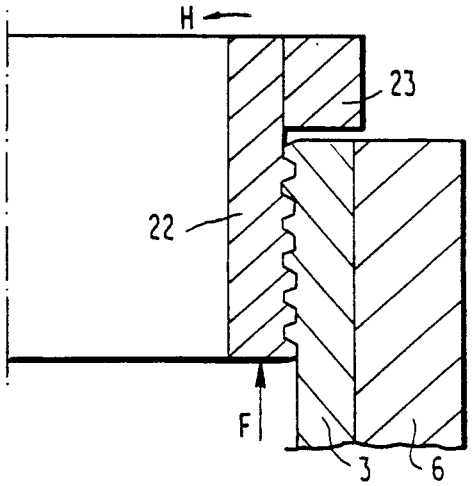
FIG. 11
FIG. 12A
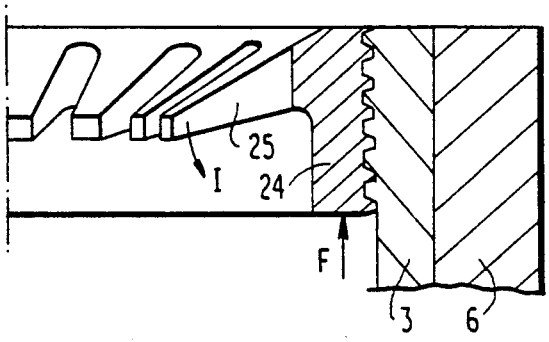
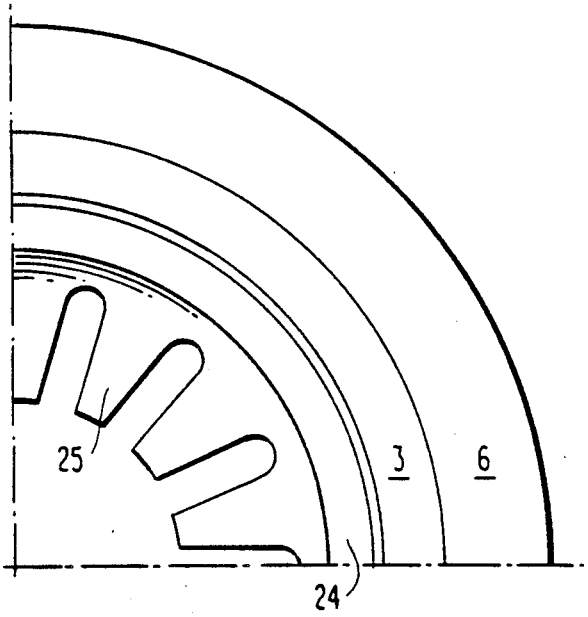
FIG. 12B
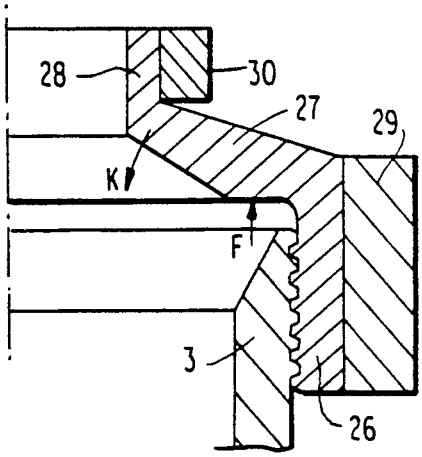
FIG. 13

SCREW JOINT

BACKGROUND OF THE INVENTION

The present invention relates to a screw joint of the kind intended for holding together two components which are arranged for rapid rotation about the centre axis of the joint and of which screw joint the mutually co-acting screw threads have a profile that exhibits flank surfaces inclined relative to said centre axis. The components are so arranged that when rotating at least one of (a) the forces transmitted by the screw joint and (b) the centrifugal forces acting on the components constitutes a deforming load on the screw joint which, if not compensated for, is liable to result in an uneven distribution of load between the various screw threads of the screw joint.

As a result of varying axial deformation occurring in the screw-joint material when the joint is under tension, the major part of the force transmitted by the screw joint is normally concentrated on a few screw threads thereof, while other screw threads of the joint are only subjected to a relatively slight load. For example, in the case of a conventional nut and screw joint, 50% of the load lies on a first screw thread, 25% of the load lies on the next screw thread and 12.5% of the load lies on the next following screw thread, whereas the remaining screw threads are relatively free of load. Since the distribution of load between the screw threads influences the dynamic strength of the screw joint, the aforementioned uneven load distribution on the screw threads causes the majority of fatigue fractures to occur at the "first" load-bearing thread. Consequently, the useful life of a screw thread could be extended considerably, if it were possible to relieve the load on this "first" screw thread, this first screw thread normally taking 50% of the total load.

Attempts to achieve more uniform distribution of the load on the screw threads of a screw joint have been made in the past by designing the nut in a particular manner, such that the pressure-activated surface is located, for steering the force flow, so that the load is distributed as uniformly as possible over a plurality of screw threads.

It is true of all types of screw joints which incorporate screw threads that have flank surfaces which slope in relation to the longitudinal axis that the axial contact between two mutually co-acting screw threads is influenced by the mutual radial position of the threads. Thus, the distribution of load between the screw threads of a screw joint can be influenced by changing the mutual radial position between the screw threads, as this will cause a change in the axial distance between mutually co-acting screw threads. Earlier attempts have been made to utilize this fact in a manner to obtain a uniform distribution of the load on a stationary screw joint, by providing one of the screw-threaded components of the screw joint with a conical screw thread along at least a part of its axial extension, c.f. for example GB-A-2 074 280. It is also possible by means of a suitable load to obtain a corresponding deformation of, e.g., a nut.

SUMMARY OF THE INVENTION

The main object of the present invention is to achieve more uniform distribution of the load between the various screw threads of a rapidly rotating screw joint of the aforesaid kind than has been possible hitherto.

The solution afforded by the present invention is based on the understanding that the load acting on different screw threads of a screw joint can be equalized by varying the axial distance between mutually co-acting threads of the screw joint axially therealong, and that this variation in axial distance can be achieved by subjecting the components carrying said screw threads to varying degrees of relative deformation in a radial direction, with the aid of the forces to which the components are subjected as a result of their rapid rotation.

It is a characteristic of a screw joint of the aforesaid kind constructed in accordance with the invention that at least one component of the screw joint includes a part which has an axial extension and which, as a result of the rapid rotation of said one component, becomes so deformed as to strive to rotate said component about axes which form right angles with axial sections through the centre axis of the screw joint and therewith to provide across the axial extension of the screw joint a variable contribution to the radial deformation of said component in a direction such as to obtain a given degree of compensation for the aforesaid deforming load on the screw joint, such that the forces transmitted by the screw joint are distributed more uniformly over the screw threads in mutual engagement with one another.

The invention affords a highly beneficial solution to the aforesaid problem, since the rotational forces to which the screw joint is subjected are utilized to achieve the desired re-distribution of load on the screw threads of the joint. This obviates, inter alia, the need for conical screw threads, such screw threads presenting serious drawbacks with respect to manufacture and to use.

Preferably, the aforesaid part having axial extension forms an integral part with said one component and is suitably of tubular or annular configuration and incorporates a portion which extends essentially in a direction in which it defines an acute angle with the rotational axis of the screw joint. As the screw joint is rapidly rotated, this angled part of said one component will strive to adopt a new position of equilibrium, therewith resulting in deformation of said component, such as to alter the radial distance between at least some of the mutually co-acting threads of the screw joint.

Since the radial deformation of a rotating symmetrical body is proportional to the ratio between density and Young's modulus, the deformation sought for in accordance with the invention can also be obtained by causing this ratio to vary in respect of said part in the axial direction of the screw joint.

This can be achieved by giving said part the form of a sleeve which projects outwardly from the screw joint and which has a reduced rigidity in the tangential direction. This reduced rigidity can be achieved by appropriate slotting of the sleeve in its axial direction.

If, on the other hand, it is desired for some reason to increase the rigidity of the outwardly projecting sleeve in the tangential direction, the sleeve may be provided conveniently with an external surround of fibre material.

The aforesaid part of said one component may also have the form of an internal sleeve whose one end is connected rigidly to a radially and inwardly projecting ballast element which defines an acute angle with said rotational axis and therewith generates a deforming torque when the screw joint is rotated rapidly.

A more pronounced effect can be obtained in this context when the aforesaid part presents at least one portion which is less resistant to bending, i.e. more flexible, than the remainder of the component to which said part belongs, suitably by providing the portion with a circumferential groove.

The invention can be applied with particular advantage to an ultracentrifuge, since the screw joint used to hold the lid of the centrifuge firmly in position on the rotor body is subjected to extremely large forces in the operating mode of the centrifuge. For instance, when the centrifuge is rotated at high speeds, the hydraulic pressure in the centrifuge rotor rises to values of such magnitude as to generate forces also in the axial direction of the centrifuge. In the case of large centrifuges, the axial load on the screw joint can reach several hundred tonnes. The screw joint thus quickly becomes a limiting factor with regard to the maximum speed at which the centrifuge rotor can be permitted to rotate.

When practicing the concepts of the invention in conjunction with a centrifuge rotor, the aforesaid components may comprise a screw-threaded rotor body and a screw-threaded locking device the screw threads of which co-act with the screw threads of said rotor body in a manner to lock the rotor body together with a lid. In this case, the locking device suitably incorporates said part which when subjected to rotation at high speeds influences the deformation of the locking device.

The locking device may have the form of a separate locking ring or may form part of the lid.

BRIEF DESCRIPTION OF THE DRAWINGS

The invention will now be described in more detail with reference to the accompanying drawings, in which

FIG. 2 is a schematic sectional view of an ultracentrifuge with the lid secured by means of an internal ring;

FIG. 3 illustrates on a larger scale the screw-thread engagement between the locking ring and the rotor body of the centrifuge according to FIG. 2, with the centrifuge at rest;

FIG. 4 is a view corresponding to FIG. 3 and shows the screw-thread engagement during rotation of the rotor body;

FIG. 5 is a schematic sectional view of an ultracentrifuge provided with an external locking ring;

FIGS. 6–13 illustrate further embodiments of a screw joint constructed in accordance with the present invention and used in conjunction with a centrifuge;

DETAILED DESCRIPTION OF THE PREFERRED EMBODIMENTS

Figure 1:
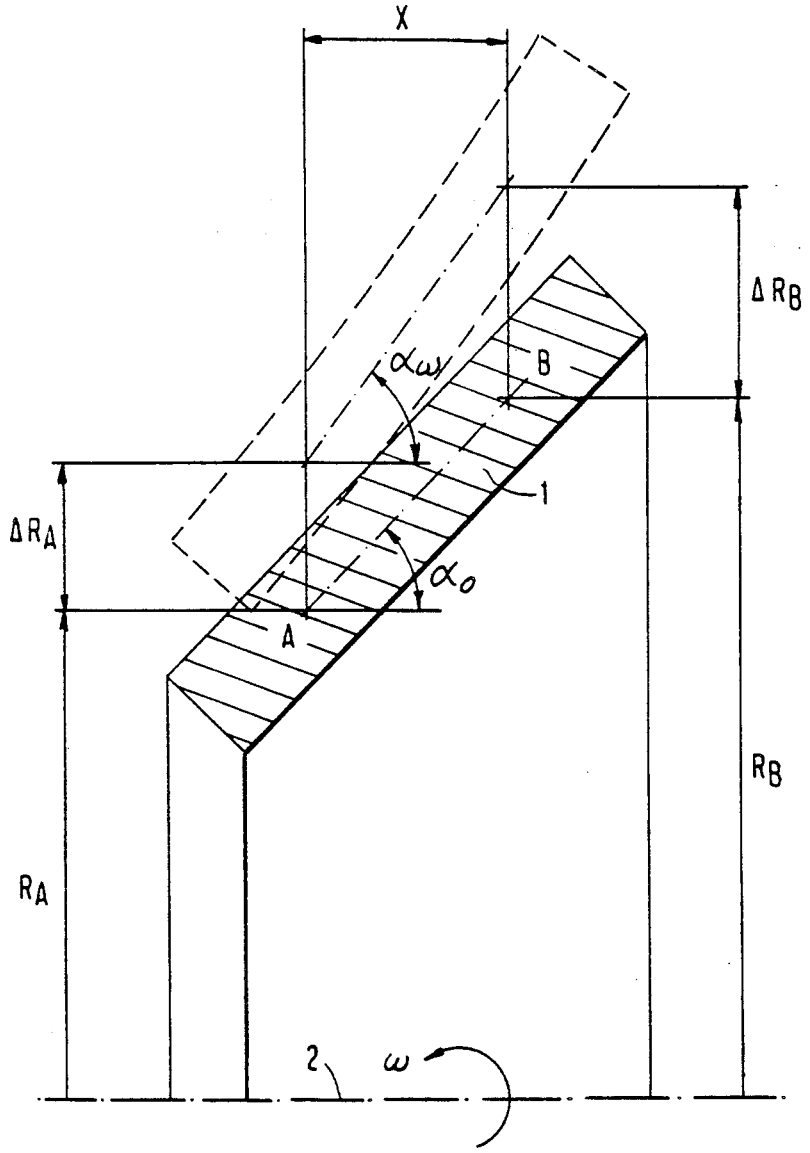
FIG. 1 illustrates the principles under which radial deformation occurs during rotation.

FIG. 1 illustrates the principles in accordance with which radial deformation will occur when a rotationally symmetrical body 1 is rotated rapidly about an axis of rotation 2. The radial deformation $\Delta R$ which occurs when a rotationally symmetrical body of small radial extension, i.e. a thin-walled sleeve or annulus, is rotated at high speed can be expressed as $$\Delta R = \rho/E \cdot R^3 \cdot \omega^2$$

where $\rho$ = the density of the material

E = Young's modulus

R = radius $\omega$ = angular velocity.

In the case of a rotating body (FIG. 1) which forms an angle with the axis of rotation, the following expressions can be written when using the designations used in the Figure:

$$\text{when } \omega = 0 \tan \alpha_0 = \frac{R_B - R_A}{X}$$

$$\text{when } \omega > 0 \tan \alpha_\omega = \frac{(R_B + \Delta R_B) - (R_A + \Delta R_A)}{X}$$

since $R_B > R_A$ and $\Delta R$ is proportional to $R^3$, $\Delta R_B > \Delta R_A$, which in turn means that $\alpha_\omega > \alpha_0$. This shows that the radially inner and radially outer parts of the body are deformed to mutually different extents, therewith generating torque, as shown by the broken line curvature of the body 1 in FIG. 1.

As will be seen from the above equation relating to radial deformation, in addition to being obtained owing to mutually different rotational radii of different parts of the body 1 such torque can also be obtained by changing the ratio of $\rho/E$ over the body, thereby obviating the need to incline the body to the axis of rotation 2. Naturally, these two functions can be combined.

The equation is slightly different in the case of a body which has substantial radial extension. The manner in which the radius, density and Young's modulus influences the formation of the body, however, does not change.

These facts can be utilized, in accordance with the invention, in conjunction with screw joints, e.g. in connection with ultracentrifuges, in a manner to obtain variable relative deformation of the two components of the screw joint, axially along the screw threads, and therewith obtain a more uniform distribution of the load over the various screw threads as stated in the introductory portion of the present specification. The ultracentrifuge illustrated in FIG. 2 includes a centrifuge body 3 having a lid 4, which is held in place by means of a screw-threaded locking ring 5, the screw threads of which are in screw engagement with an internal screw thread on the centrifuge body 3.

In the illustrated embodiment of FIG. 2, the centrifuge body 3 is embraced by an external fibre bandage 6. Although this bandage is not a necessary feature of the invention, its presence does afford important advantages in connection with an optimisation of the screw joint, as explained below. It will be understood that the greater the flank angle of the screw threads, the easier it is to distribute the load over a plurality of screw threads. On the other hand, it will also be seen to be true that the greater the flank angle, the greater the forces that are transmitted radially between the inner and the outer parts of the screw joint. Since it is desirable that the two screw-joint components are, and remain, well centred in relation to one another, in the absence of pronounced radial clearance between said radially inner and radially outer component parts, it is necessary for the outer part of the screw joint to exhibit a much greater rigidity radially in rotation than the inner part of the screw joint. Furthermore, since the outer part of the screw joint is located at a greater median radius from the rotational axis than the inner part thereof, it is necessary for the ratio $\rho/E$ in respect of the outer part to be smaller than that of the inner part. This can be achieved with the aid of the illustrated fibre bandage 6. This applies to all embodiments of the various Figures in these drawings.

The upper part of the locking ring 5 of the FIG. 2 embodiment merges with a deformation ring 7, which forms an acute angle with the rotational axis 8. Located at the upper extremity of the deformation ring 7 is an upstanding flange 9, by means of which the locking ring 5 can be fitted to and removed from the centrifuge with the aid of a suitable friction tool. The reference 10 identifies a circumferential groove which facilitates deformation of the locking ring 5 and controls the location at which deformation takes place.

FIG. 3 is an enlarged sectional view of the screw joint, illustrating screw-thread engagement of the locking ring 5 with the centrifuge body 3 and also illustrating the state of the screw joint when the centrifuge is stationary and not subjected to load. It will be seen that in this case all of the screw threads are in essentially uniform engagement with one another.

FIG. 4 is a sectional view similar to that of FIG. 3, but with the centrifuge in rotation, the lid 4 being therewith subjected to a force F as a result of this rotation and as a result of the mass located in the centrifuge. Torque will occur when the force F acts on the locking ring 5 at a given radial distance from the force-transferring screw joint. The screw joint illustrated in FIG. 4 represents a pressure joint, wherewith the first screw threads will normally take up the heaviest load. Because of the torque generated by the force F, the last screw threads in the upper part of the screw joint illustrated in FIG. 4 will also take-up a heavy load.

When the centrifuge is rotated at high speeds, the deformation ring 7 will strive to take a new position of equilibrium and, similar to the body 1 of the FIG. 1 embodiment, will tend to rotate in the direction of the arrow A. It will be understood from the aforegoing that the reason for this tendency towards rotation is because parts or portions of the deformation ring 7 located at a greater radial distance from the rotational axis are deformed to a greater extent than those parts which lie closer to said axis. Thus, there is generated a torque which deforms the locking ring 5 in a manner to increase the radial distance between the upper screw threads of the illustrated embodiment, therewith lightening the load thereon. Consequently, because the torque resulting from the force F and movement of the deformation ring 7 in the direction of the arrow A, the centrally located screw threads of the screw joint will engage each other more firmly, whereas the screw engagement of the screw threads at the two extremities of the screw joint will slacken slightly. This means that the load on the outer screw threads will decrease and that the load on the intermediate screw threads will increase to a corresponding extent.

The centrifuge body 3 of the ultracentrifuge illustrated in FIG. 5 is provided with an external screw thread which co-acts with an external locking ring 11 intended for holding the lid 4 in its intended position. The locking ring 11 of the FIG. 5 embodiment is provided with an external reinforcing fibre-bandage 12, in addition to the fibre bandage 6. When the centrifuge rotates, this screw joint is placed under tension which normally means that the outer screw threads at the two extremities of the screw joint will be subjected to the highest load. The load on the bottom screw threads of the illustrated screw joint, however, will decrease as a result of the tendency of the deformation ring 13 to bend in the direction of the arrow B when the centrifuge is rotated at high speeds. This movement results in torque which causes radial deformation of the lower end of the locking ring 11, which in turn increases the radial distance between mutually co-acting screw threads at said end, whereas the depth of engagement of the intermediate screw threads increase. Correspondingly, the force F from the lid generates torque which relieves the load on the upper screw threads to some extent. Thus, this embodiment will also afford equalization of the load on the various screw threads, by re-distributing the load from the outer screw threads to the intermediate screw threads.

FIG. 6 is a schematic sectional view of part of a centrifuge having an internal lid-locking ring 14, in accordance with FIG. 2. In this embodiment, however, the locking ring 14 is provided with an outwardly directed deformation ring 15, which tends to move in the direction of the arrow C such that the penetration depth between the upper screw threads increases, said screw threads thus taking-up a greater part of the load and therewith partially relieving the load on the remaining screw threads. A corresponding effect is also obtained with the embodiment illustrated in FIG. 7 which incorporates an inwardly and downwardly directed deformation ring 16, as illustrated by means of the arrow D. The locking ring of the FIG. 7 embodiment, however, is more rigid in the radial direction than the locking ring of the FIG. 6 embodiment, due to the fact that the homogenous ring has more material on a smaller radius.

As will be understood from the aforegoing, the distribution of load between the various screw threads of the screw joint depends, in all cases, essentially on the extent to which the axially directed force F acts on the screw joint and also on the flank angles of the screw threads. In this regard, FIG. 8 illustrates an embodiment in which the load on the uppermost screw threads of the illustrated screw joint is decreased as a result of movement of the deformation ring 17 in the direction E while increasing the load on the most central screw threads of the joint. In this embodiment, the deformation ring 17 is mounted directly on the centrifuge body 3, which is connected to an inner locking ring 18 via the screw joint.

FIG. 9 illustrates a similar embodiment, although in this case the deformation ring 19 is directed outwardly and downwardly, which results in a tendency toward movement in the direction of the arrow M. This movement results in more of the load being transferred to the uppermost screw threads of the illustrated screw joint.

The function of the aforedescribed embodiments is all based on the provision of a deformation ring which defines an acute angle with the axis of rotation, therewith to subject the screw joint to deforming torque.

According to the formula given in the introduction, there can be used instead of a deformation ring having parts located at mutually different radial distances from the axis of rotation, a ring in which values of the relationship $\rho/E$ vary in the axial direction. This can be achieved in practice by means of a ring whose rigidity varies in the axial direction. An example of one such ring is illustrated in FIG. 10, in which the reference numerals 3 and 6 identify a centrifuge rotor body and a fibre bandage respectively, as in the earlier embodiments, whereas the reference 20 indicates a combined locking and deformation ring. In this embodiment, the deformation ring includes a part which projects upwardly over the centrifuge rotor body 3, this part having formed axially therein slots 21 which reduce the rigidity of said part in a tangential direction. Thus, when in rotation, the upper part of the ring 20 will tend to move outwardly in the direction of the arrow G, therewith giving rise to deforming torque, which causes a greater part of the load transferred by the screw joint to be placed on the upper screw threads of the illustrated screw joint.

An embodiment having a corresponding function is illustrated in FIG. 11, in which the free, upper part of the combined locking and deformation ring 22 is supplemented with a stiffening ring 23 of a composite material, suitably a material that incorporates carbon fibres. As a result, the upper part of the ring 22 will be highly rigid in a radial direction, whereas the lower, screw-threaded part of the ring will have a lower radial rigidity. Consequently, a relative torque is obtained in the direction of the arrow H, causing the load on the uppermost screw threads of the illustrated screw joint to be relieved. This lightening of the load on the uppermost screw threads is further amplified by the fact that the screw-threaded portion of the rotor body 3 is deformed radially to a greater extent than the upper end of the deformation ring 22, due to the greater radius of the rotor body.

FIGS. 12A and 12B show a partly sectional side view and a top-plan view respectively of an embodiment of a combined locking and deformation ring 24. The upper end of the ring 24 is rigidly connected with radially and inwardly projecting ballast devices 25, which slope downwardly in a manner to form an acute angle with the axis of rotation. As a result of centrifugal forces these devices tend to move in the direction of the arrow I and therewith distribute part of the load from the upper screw threads of the illustrated screw joint to the most central screw threads thereof.

The embodiment illustrated in FIG. 13 incorporates an external locking ring 26 screwed onto the rotor body 3 of the centrifuge. In this embodiment both the screw-threaded part and a flange 28 projecting upwardly from the associated deformation ring 27 are each embraced by a reinforcing, composite ring 29 and 30 respectively. Thus, as a result of movement in the direction of the arrow K, the deformation ring 27 will transfer load from the underlying screw threads to the uppermost screw threads of the illustrated screw joint. Furthermore, the deformation ring 27 causes a decrease in the stress concentrations at the transition between the locking ring 26 and the deformation ring 27, which is highly beneficial.

Figure 14:
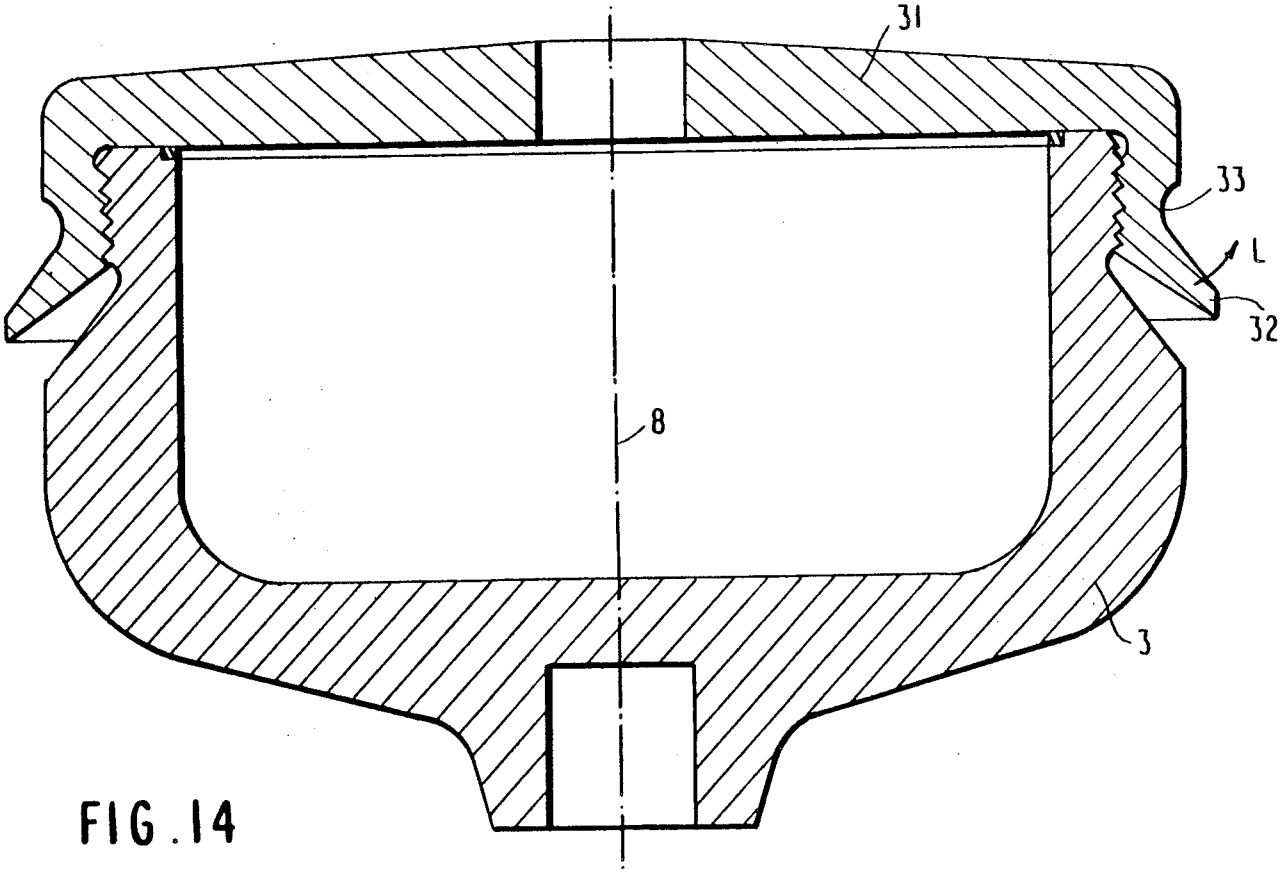
FIG. 14 is a sectional view of an ultracentrifuge equipped with a screw-threaded lid.

FIG. 14 illustrates an ultracentrifuge with which a lid 31 is screwed directly onto the rotor body 3 of the centrifuge. The lid 31 of this embodiment is provided on its lower edge with a deformation ring 32 and a groove 33 which reduces the flexural rigidity of the ring. This screw joint is under tension and the deformation ring 32 is caused to move in the direction of the arrow L, therewith relieving the load on the heavily loaded lower screw threads of the joint and transferring a corresponding load to the most central screw threads. Since the lid of this embodiment extends radially in towards the axis of rotation 8, the lid is extremely rigid or inflexible and therefore requires no composite ring.

A number of solutions to the problem of equalizing the load on the screw threads of a screw joint have been presented in the aforegoing. It will be understood, however, by those skilled in this art that further variants are conceivable and that selective combinations of the illustrated embodiments can be employed. Furthermore, although all of the illustrated and described screw joints have been used in conjunction with ultracentrifuges, it will be understood that corresponding techniques can be applied in all cases where a screw joint is used in conjunction with rapidly rotating objects. The design of the deformation rings used can also be varied as desired and said rings may also be manufactured as separate elements and connected rigidly with the desired component of the screw joint. In the case of special applications, both components of the screw joint may each be provided with an individual deformation ring.

I claim:

1. A screw joint comprising:

a first component;

a second component;

first and second screw threads being integrally formed with and on said first and second components, respectively, wherein said first and second components are coupled to each other through said first and second screw threads mutually co-acting with each other, and said first and second screw threads of said first and second components have a thread profile with flank surfaces inclined in relation to a longitudinal axis of a rotational direction of said screw joint, wherein said first and second components are arranged so that during rotation thereof at least one of a (a) the forces transferred by said screw joint and (b) the centrifugal forces acting on said first and second components constitute a deforming load on said screw joint which creates an uneven load distribution between said first and second screw threads of said screw joint, wherein at least one of said first and second components comprises a part, said part being coupled to said at least one of said first and second components at one end of one of said first and second screw threads corresponding to said at least one of said first and second components and having a radial extension and an axial extension, and wherein said part is deformed by the rapid rotation of said first and second components, so that portions of said at least one of said first and second components are rotated about axes which form right angles with axial sections of said screw joint through said longitudinal axis of said rotational direction of said screw joint and which, over the axial extension of the screw joint, radially deform said at least one of said first and second components in a direction so as to compensate for said deforming load on the screw joint by a predetermined amount.

2. A screw joint according to claim 1, wherein said part of said at least one of said first and second components is an integral part of said at least one of said first and second components.

3. A screw joint according to claim 1, wherein said part comprises a ring-shaped element.

4. A screw joint according to claim 3, wherein said ring-shaped element includes a portion which extends substantially in a direction which forms an acute angle with said longitudinal axis of said rotational direction of said screw joint.

5. A screw joint according to claim 1, wherein said part comprises an inner sleeve, having one end rigidly connected to radially and inwardly extended ballast devices which define an acute angle with said longitudinal axis of said rotational direction of said screw joint.

6. A screw joint according to claim 1, wherein said part has at least one portion, suitably provided with a circumferential groove, having a lower resistance to bending than the remainder of said at least one of said first and second components.

7. A screw joint according to any of claims 1–4 or 8–9, wherein said first and second components comprise a screw-threaded centrifuge rotor body and a screw-threaded locking device, the screw threads of said locking device co-acting with the screw threads of said rotor body so as to lock the rotor body with a lid thereto, and wherein said screw-threaded locking device incorporates said part which, when subjected to rotation at high speeds, influences the deformation of the locking device.

8. A screw joint according to claim 10, wherein said screw-threaded locking device comprises a separate locking ring.

9. A screw joint according to claim 10, wherein said screw-threaded locking device forms part of said lid.

10. A screw joint according to claim 1, wherein said first and second components comprise a rotor member and a lid member.

11. A screw joint according to claim 1, wherein said first and second components comprise a rotor member and a locking ring.

12. A screw joint comprising:

a first component;

a second component;

first and second screw threads being integrally formed with and on said first and second components, wherein said first and second components are coupled to each other through said first and second screw threads mutually co-acting with each other, and said first and second screw threads of said first and second components have a thread profile with flank surfaces inclined in relation to longitudinal axis of a rotational direction of said screw joint, wherein said first and second components are arranged so that during rotation thereof at least one of (a) the forces transferred by said screw joint and (b) the centrifugal forces acting on said first and second components constitute a deforming load on said screw joint which creates an uneven load distribution between said first and second screw threads of said screw joint, wherein at least one of said first and second components comprises a part, said part being coupled to said at least one of said first and second components at one end of one of said first and second screw threads and having an axial extension, and wherein said part is deformed by the rapid rotation of said first and second components, so that portions of said at least one of said first and second components are rotated about axes which form right angles with axial sections of said screw joint through said longitudinal axis of said rotational direction of said screw joint and which, over the axial extension of the screw joint radially deform said at least one of said first and second components in a direction so as to compensate for said deforming load on the screw joint by a predetermined amount, and wherein said part has a ratio between density and rigidity in the tangential direction which varies in an axial direction of said screw joint.

13. A screw joint according to claim 12, wherein said part comprises a sleeve which projects out from said screw joint and which has reduced rigidity in the tangential direction, said sleeve having axially extending slots.

14. A screw joint according to claim 12, wherein said part comprises a sleeve which projects out from the screw joint and which has increased rigidity in the tangential direction, said sleeve suitably being embraced by an external fiber reinforcement.

* * * * *